US010641266B2

(12) United States Patent
Takeda et al.

(10) Patent No.: US 10,641,266 B2
(45) Date of Patent: May 5, 2020

(54) TRANSFER DEVICE

(71) Applicants: AISIN AW CO., LTD., Anjo-shi, Aichi-ken (JP); TOYOTA JIDOSHA KABUSHIKI KAISHA, Toyota-shi, Aichi-ken (JP)

(72) Inventors: Mitsuhiro Takeda, Toyota (JP); Yoshihiro Mizuno, Nagoya (JP); Tetsuya Kohno, Okazaki (JP); Yoshinobu Soga, Toyota (JP); Syuji Moriyama, Nagakute (JP); Hiromitsu Nitani, Toyota (JP); Takafumi Inagaki, Toyota (JP)

(73) Assignees: AISIN AW CO., LTD., Anjo (JP); TOYOTA JIDOSHA KABUSHIKI KAISHA, Toyota (JP)

( * ) Notice: Subject to any disclaimer, the term of this patent is extended or adjusted under 35 U.S.C. 154(b) by 104 days.

(21) Appl. No.: 15/539,434

(22) PCT Filed: Jan. 6, 2016

(86) PCT No.: PCT/JP2016/050198
§ 371 (c)(1),
(2) Date: Jun. 23, 2017

(87) PCT Pub. No.: WO2016/117353
PCT Pub. Date: Jul. 28, 2016

(65) Prior Publication Data

US 2017/0356444 A1 Dec. 14, 2017

(30) Foreign Application Priority Data

Jan. 19, 2015 (JP) ..... 2015-007547

(51) Int. Cl.
*F04C 2/344* (2006.01)
*F04C 14/02* (2006.01)
(Continued)

(52) U.S. Cl.
CPC ..... *F04C 2/344* (2013.01); *F01C 21/0863* (2013.01); *F01C 21/108* (2013.01);
(Continued)

(58) Field of Classification Search
CPC .... F01C 21/0863; F01C 21/108; F04C 2/344; F04C 2/3446; F04C 11/00; F04C 11/003;
(Continued)

(56) References Cited

U.S. PATENT DOCUMENTS 4,386,891 A * 6/1983 Riefel ..... F01C 21/0863 418/269
5,657,629 A * 8/1997 Folsom ..... F04C 14/20 60/487
(Continued)

FOREIGN PATENT DOCUMENTS

JP H10-306783 A 11/1998
JP 2001-173575 A 6/2001
(Continued)

OTHER PUBLICATIONS

Apr. 5, 2016 International Serach Report issued in Patent Application No. PCT/JP2016/050198.

*Primary Examiner* — Barry Gooden, Jr.
(74) *Attorney, Agent, or Firm* — Oliff PLC

(57) ABSTRACT

A transfer device that includes a case that houses a transfer mechanism; a strainer that suctions oil stored in a lower portion of the case; a valve body that has a hydraulic supply circuit that supplies a hydraulic pressure to the transfer mechanism and a suction oil path that discharges an extra hydraulic pressure that is extra for the hydraulic supply circuit; a first suction inlet that communicates with one of the suction oil path and the strainer and a second suction inlet that communicates with the other of the suction oil path and the strainer, and a balanced vane pump.

3 Claims, 4 Drawing Sheets

(51) Int. Cl.

| | |
|---|---|
| ***F04C 14/26*** | (2006.01) |
| ***F04C 11/00*** | (2006.01) |
| ***F01C 21/08*** | (2006.01) |
| ***F01C 21/10*** | (2006.01) |
| ***F04C 14/06*** | (2006.01) |
| ***F04C 15/06*** | (2006.01) |
| ***F04C 29/02*** | (2006.01) |

(52) U.S. Cl.
CPC ..... *F04C 2/3446* (2013.01); *F04C 11/00* (2013.01); *F04C 11/003* (2013.01); *F04C 14/02* (2013.01); *F04C 14/065* (2013.01); *F04C 14/26* (2013.01); *F04C 15/064* (2013.01); *F04C 29/021* (2013.01); *F04C 2240/20* (2013.01); *F04C 2240/30* (2013.01); *F04C 2240/60* (2013.01); *F04C 2270/56* (2013.01)

(58) Field of Classification Search
CPC ..... F04C 14/02; F04C 14/062; F04C 14/26; F04C 15/064; F04C 29/021
See application file for complete search history.

(56) References Cited

U.S. PATENT DOCUMENTS 6,149,409 A * 11/2000 Palakodati ..... F01C 21/104 418/133
7,946,389 B2 * 5/2011 Kakinami ..... F16H 57/04 123/196 R
2001/0036413 A1 * 11/2001 McFadden ..... E02F 9/2239 417/286
2004/0001762 A1 * 1/2004 Matumoto ..... F01C 21/0863 417/244
2005/0042126 A1 * 2/2005 Shinoda ..... F01C 1/344 418/259
2005/0180870 A1 * 8/2005 Stanley ..... F04B 23/06 417/440
2006/0073027 A1 * 4/2006 Ide ..... F01C 21/108 417/310
2007/0134120 A1 * 6/2007 Fujita ..... F01C 21/108 418/112
2010/0329917 A1 * 12/2010 Ando ..... F01C 21/0863 418/133
2012/0261009 A1 * 10/2012 Miyachi ..... F01L 1/3442 137/565.01
2013/0251571 A1 * 9/2013 Iijima ..... F04C 2/00 418/28
2014/0271310 A1 * 9/2014 Whitesel ..... F04C 18/3446 418/191
2017/0356444 A1 * 12/2017 Takeda ..... F04C 2/344
2018/0128107 A1 * 5/2018 Inagaki ..... F01C 21/0836
2018/0135625 A1 * 5/2018 Naganuma ..... F04C 2/344

FOREIGN PATENT DOCUMENTS

JP 2010-014101 A 1/2010
JP 2014-126043 A 7/2014

* cited by examiner

TRANSFER DEVICE

BACKGROUND

The present disclosure relates to a transfer device that is suitable for application to a vehicle such as an automobile, and in particular to a transfer device to which a vane pump is applied as an oil pump that generates a hydraulic pressure of working oil or lubricating oil to be supplied to a transfer mechanism.

There has hitherto been utilized an oil pump as a device that generates a hydraulic pressure of working oil, lubricating oil, or the like (hereinafter referred to simply as "oil") in an automatic transmission for a vehicle, for example. Among others, vane pumps that are unlikely to generate vibration and that are relatively small in size have been widely prevalent. For example, there is known a hydraulic supply device that includes a balanced vane pump (hereinafter referred to simply as a "vane pump") as a hydraulic supply device that supplies a hydraulic pressure to a hydraulic device such as a valve body of the automatic transmission. An example of such a vane pump includes a first discharge port and a second discharge port, with the first discharge port communicating with the hydraulic device via a switching valve and with the second discharge port communicating with the hydraulic device not via a switching valve (see Japanese Patent Application Publication No. 2010-14101).

The vane pump is provided with a suction oil path that communicates with a strainer through which oil stored in a tank is suctioned. The suction oil path is merged with a return passage that leads oil discharged from the hydraulic device. This allows the vane pump to suction an extra hydraulic pressure from the hydraulic device, and increases the suctioned hydraulic pressure compared to a case where oil is suctioned through only the strainer. Thus, occurrence of cavitation can be suppressed.

In the hydraulic supply device described in Japanese Patent Application Publication No. 2010-14101, however, the suction oil path of the vane pump and the return oil path are merged with each other outside the vane pump. Thus, it is difficult that the suction oil path and the return oil path communicate with the vane pump after being merged with each other depending on the positions of installation of the strainer, the hydraulic device, and the vane pump, which may lower the degree of freedom in design.

An exemplary aspect of the present disclosure provides a transfer device in which a strainer and a hydraulic device can be disposed on opposite sides of a balanced vane pump at the center while suppressing occurrence of cavitation.

The present disclosure provides a transfer device including: a case that houses a transfer mechanism; a strainer that suctions oil stored in a lower portion of the case; a valve body that has a hydraulic supply circuit that supplies a hydraulic pressure to the transfer mechanism and a suction oil path that discharges an extra hydraulic pressure that is extra for the hydraulic supply circuit; a first suction inlet that communicates with one of the suction oil path and the strainer and a second suction inlet that communicates with the other of the suction oil path and the strainer; and a balanced vane pump that has a first suction port which faces the first suction inlet and into which oil flows from the first suction inlet, a second suction port which faces the second suction inlet and into which oil flows from the second suction inlet, a first discharge outlet and a second discharge outlet that discharge oil having flowed thereinto from the first suction inlet and the second suction inlet to the hydraulic supply circuit, and a communication oil path disposed downstream of the first suction port and downstream of the second suction port to communicate between the first suction port and the second suction port.

In the transfer device, the first suction inlet of the vane pump communicates with the suction oil path, and the second suction inlet communicates with the strainer. Thus, oil paths can be disposed without being merged with each other in the case where the valve body is disposed on the opposite side of the vane pump from the strainer. Consequently, it is possible to improve the degree of freedom in design. In addition, a flow rate from the suction oil path and the strainer is supplied to the first and second suction ports through the communication oil path. Thus, not only oil from the strainer but also an extra hydraulic pressure from the valve body can be suctioned. Therefore, the hydraulic pressure of oil being suctioned is increased compared to a case where only oil from the strainer is suctioned. Thus, it is possible to suppress occurrence of cavitation during low-speed rotation and high-speed rotation of the vane pump.

DETAILED DESCRIPTION OF EMBODIMENTS

Figure 1:
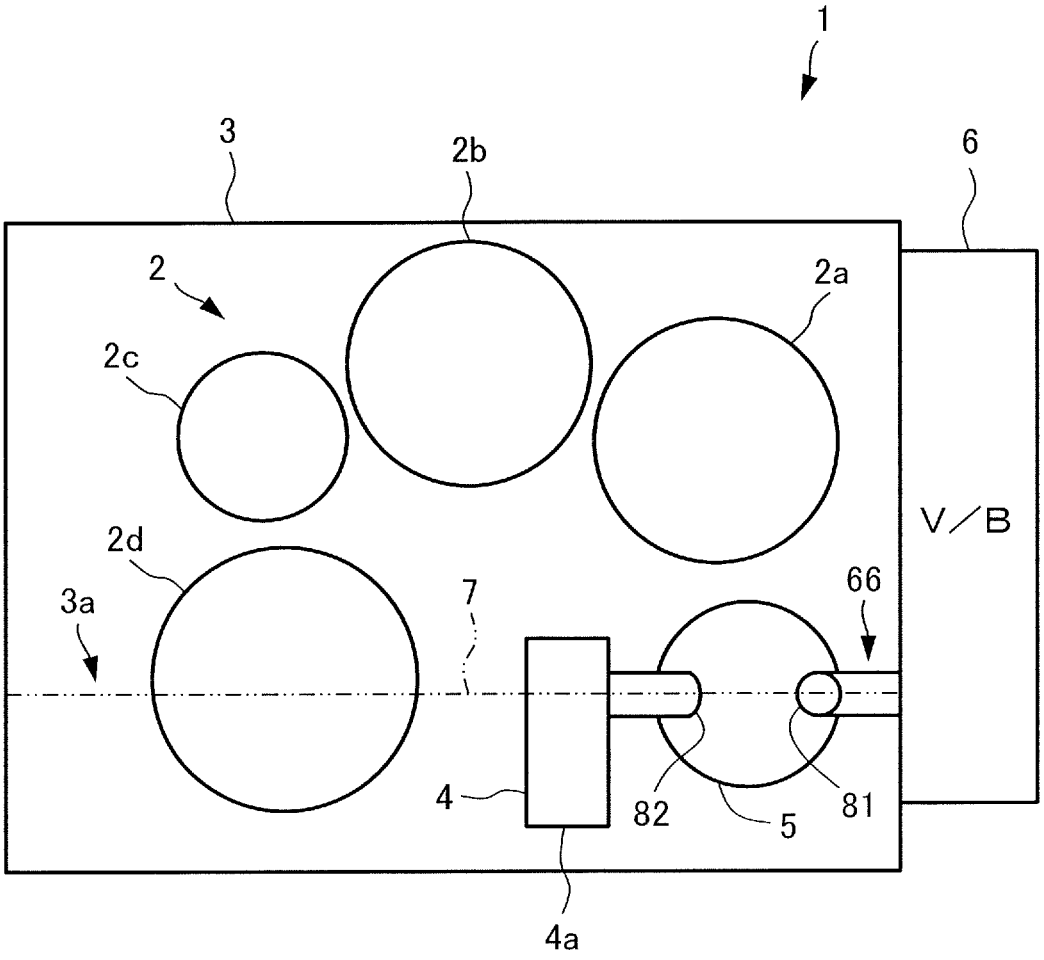
FIG. 1 is a schematic diagram illustrating a vehicle drive device according to an embodiment.

A transfer device according to an embodiment will be described below with reference to FIGS. 1 to 4. In the embodiment, the transfer device is applied to a vehicle drive device 1 that includes an automatic transmission.

A schematic configuration of the vehicle drive device 1 according to the embodiment will be described with reference to FIG. 1. The vehicle drive device 1 includes a speed change mechanism (transfer mechanism) 2, a case 3 that houses the speed change mechanism 2, a strainer 4 provided at a lower portion 3*a* inside the case 3, a vane pump 5 installed inside the case 3, and a valve body 6 provided on a side surface of the case 3.

The speed change mechanism 2 is a belt-type continuously variable transmission that has four axes, namely a first axis 2*a*, a second axis 2*b*, a third axis 2*c*, and a fourth axis 2*d*, for example. It should be noted, however, that the speed change mechanism 2 is not limited to a four-axis belt-type continuously variable transmission, and may be a speed change mechanism of various types such as a multi-speed transmission. Oil 7 to be utilized as working oil, lubricating oil, or the like is stored in the lower portion 3*a* of the case 3. The strainer 4 communicates with the vane pump 5 to suction the oil 7 stored in the lower portion 3*a* of the case 3. In the embodiment, the strainer 4 is installed with a suction inlet 4*a* directed downward. It should be noted, however, that the suction inlet 4*a* may be directed in a different direction such as sideways. The speed change mechanism 2, the case 3, and the strainer 4 may be those known in the art, and thus the configuration of such components will not be described in detail.

Figure 2:
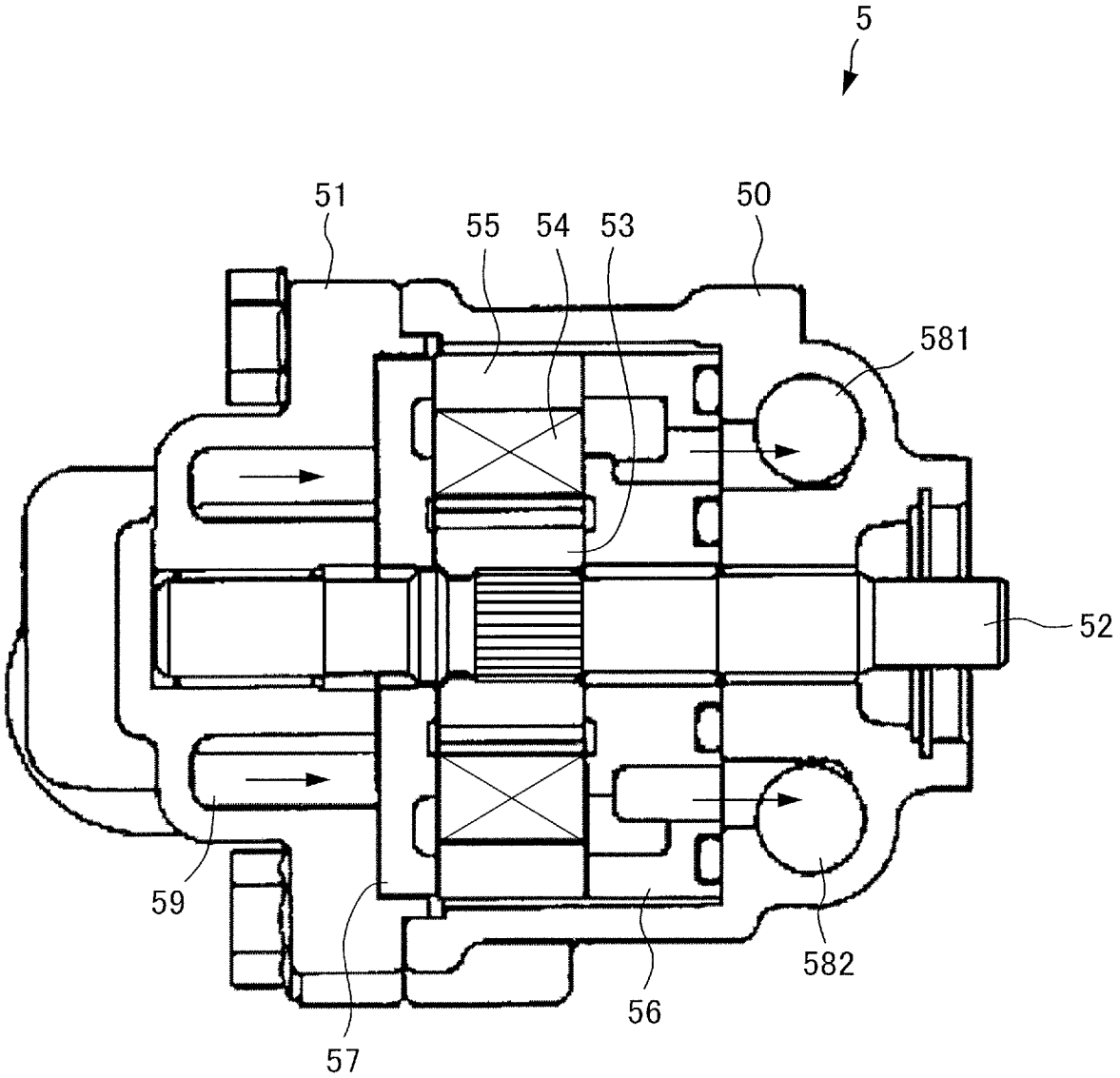
FIG. 2 is a vertical sectional view illustrating a vane pump according to the embodiment.

The vane pump 5 is of a balanced type. As illustrated in FIG. 2, the vane pump 5 includes a pump body 50, a pump cover 51, a drive shaft 52, a rotor 53, vanes 54, a cam ring 55, a body-side side plate 56, and a cover-side side plate 57.

The pump cover 51 is fastened to the pump body 50 to seal an internal space. The drive shaft 52 is rotatably supported by the pump body 50 and the pump cover 51, and coupled to a drive source (not illustrated) to be rotated. The pump body 50 has a main discharge pressure chamber 581 and a sub discharge pressure chamber 582 formed to face the body-side side plate 56. Meanwhile, the pump cover 51 has a suction pressure chamber 59 formed to face the cover-side side plate 57.

The rotor 53 has a plurality of slits disposed radially at constant intervals. The vanes 54 have a generally rectangular flat plate shape, and are slidably inserted into the slits of the rotor 53. When the rotor 53 is rotated, the distal ends of the vanes 54 are brought into sliding contact with the inner peripheral surface of the cam ring 55 so that the vanes 54 make two reciprocal motions in the radial direction of the rotor 53 while the rotor 53 makes one rotation. In addition, a pump chamber is defined by the outer peripheral surface of the rotor 53, the vanes 54 which are adjacent to each other, the inner peripheral surface of the cam ring 55, the body-side side plate 56, and the cover-side side plate 57.

Figure 3:
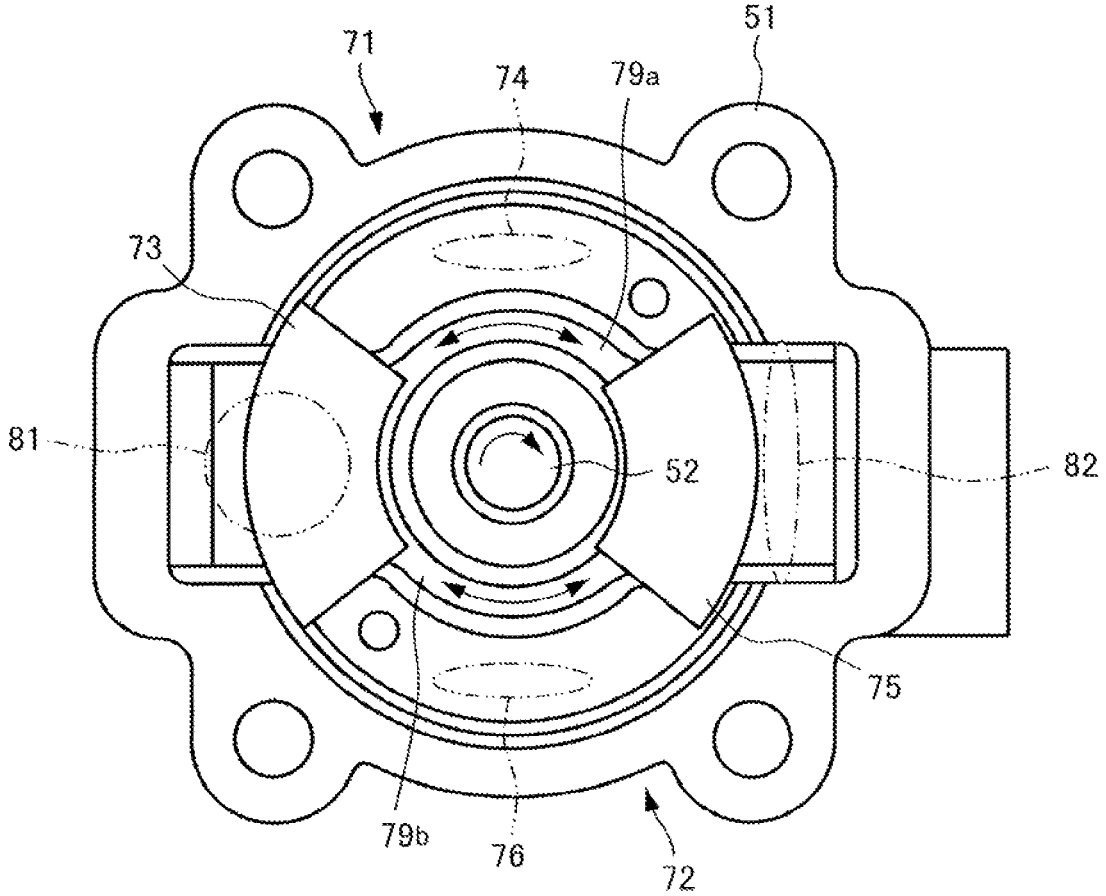
FIG. 3 is a bottom view illustrating a pump cover of the vane pump according to the embodiment.

In addition, as illustrated in FIG. 3, the vane pump 5 includes a main-side pump portion 71 that supplies a hydraulic pressure to a main-side oil path a1 of a hydraulic supply circuit 60, to be discussed later, and a sub-side pump portion 72 that supplies a hydraulic pressure to a sub-side oil path a2. The main-side pump portion 71 includes a main-side suction port (first suction port) 73 and a main-side discharge port 74. The sub-side pump portion 72 includes a sub-side suction port (second suction port) 75 and a sub-side discharge port 76.

A communication oil path 79 that communicates between the main-side suction port 73 and the sub-side suction port 75 is disposed downstream of the main-side suction port 73 and downstream of the sub-side suction port 75. The main-side discharge port 74 communicates with the main discharge pressure chamber 581, and the sub-side discharge port 76 communicates with the sub discharge pressure chamber 582 (see FIG. 2). In addition, as further illustrated in FIG. 3, the communication oil path 79 has a first communicating oil path 79*a* that extends between the main-side suction port 73 and the sub-side suction port 75 on a first side of the drive shaft 52 (top side when viewing FIG. 3) and a second communicating oil path 79*b* that extends between the main-side suction port 73 and the sub-side suction port 75 on a second side of the drive shaft 52 (bottom side when viewing FIG. 3) opposite the first side of the drive shaft 52, as viewed from the axial direction of the drive shaft 52.

Figure 4:
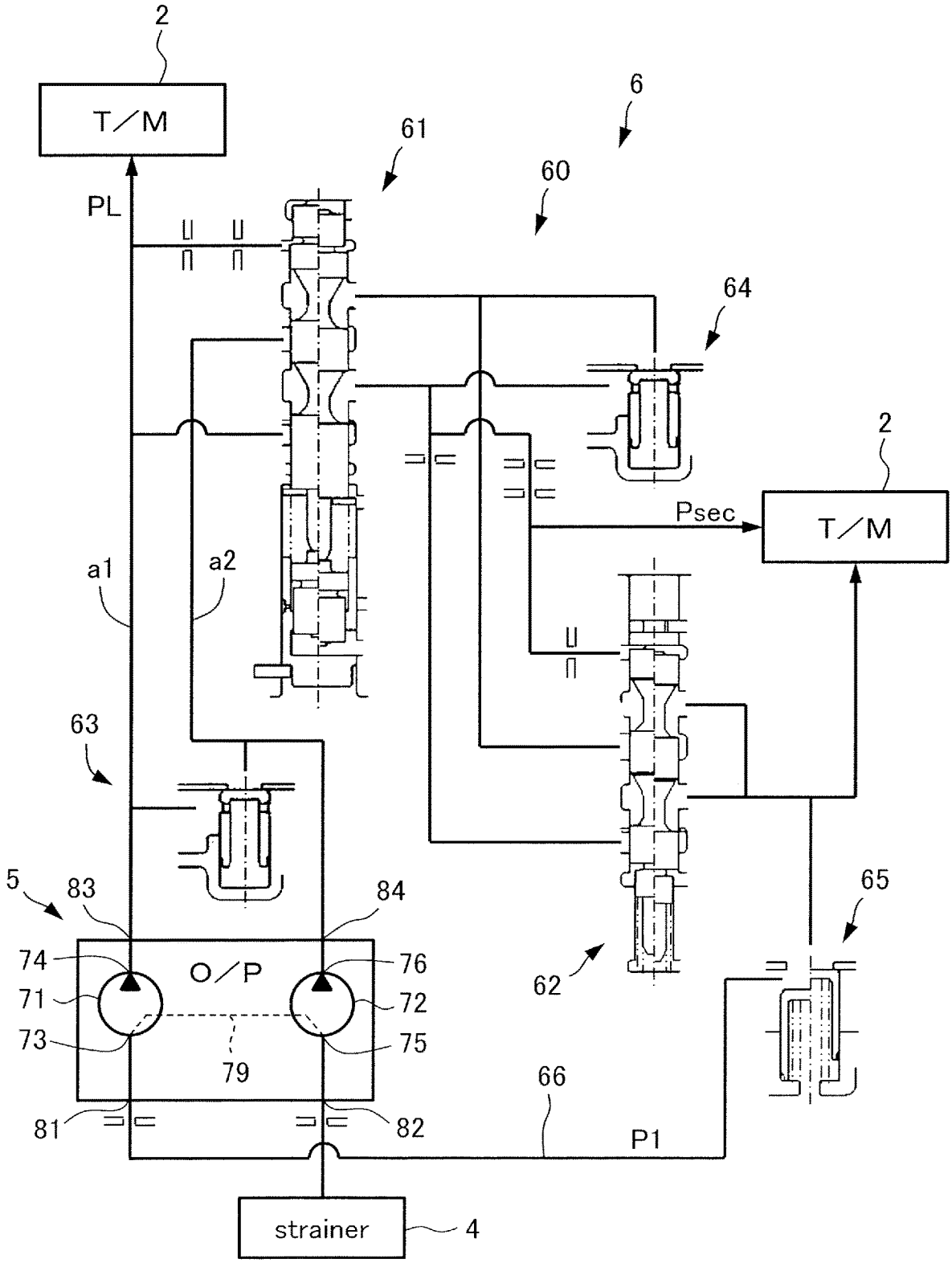
FIG. 4 is a diagram illustrating a part of a hydraulic supply circuit according to the embodiment.

Furthermore, the vane pump (O/P) 5 includes a main-side suction inlet (first suction inlet) 81 and a sub-side suction inlet (second suction inlet) 82 formed by making openings in the pump cover 51 and a main-side discharge outlet (first discharge outlet) 83 and a sub-side discharge outlet (second discharge outlet) 84 formed by making openings in the pump body 50 (see FIG. 4).

The main-side suction inlet 81 communicates with the suction oil path 66, and is disposed to face the main-side suction port 73. That is, the main-side suction port 73 faces the main-side suction inlet 81, and allows oil to flow thereinto from the main-side suction inlet 81. The sub-side suction inlet 82 communicates with the strainer 4, and is disposed to face the sub-side suction port 75. That is, the sub-side suction port 75 faces the sub-side suction inlet 82, and allows oil to flow thereinto from the sub-side suction inlet 82. In addition, the communication oil path 79 communicates between the main-side suction inlet 81 and the sub-side suction inlet 82. In addition, the main-side discharge outlet 83 communicates with the main-side oil path a1 of the hydraulic supply circuit 60 to be discussed later, and the sub-side discharge outlet 84 communicates with the sub-side oil path a2 of the hydraulic supply circuit 60. That is, the main-side discharge outlet 83 discharges oil having flowed thereinto from the main-side suction inlet 81 to the hydraulic supply circuit 60, and the sub-side discharge outlet 84 discharges oil having flowed thereinto from the sub-side suction inlet 82 to the hydraulic supply circuit 60.

Here, in the vehicle drive device 1, as illustrated in FIG. 1, the strainer 4, the vane pump 5, and the valve body 6 are disposed such that the strainer 4 and the valve body 6 are on opposite sides of the vane pump 5 at the center in the horizontal direction. That is, the valve body 6 is disposed on the opposite side of the vane pump 5 from the strainer 4. Consequently, the valve body 6 can be installed on the front surface of the case 3, which can contribute to a reduction in size of the vehicle.

The valve body 6 is installed on the front surface, among the side surfaces, of the case 3 (see FIG. 1). As illustrated in FIG. 4, the valve body (V/B) 6 has the hydraulic supply circuit 60 which supplies a hydraulic pressure to the speed change mechanism 2, and the suction oil path 66 which discharges an extra hydraulic pressure P1 that is extra for the hydraulic supply circuit 60. The hydraulic supply circuit 60 includes a primary regulator valve 61, a secondary regulator valve 62, a first sub check valve 63, a second sub check valve 64, and a lubrication check valve 65, for example.

The primary regulator valve 61 communicates with the main-side discharge outlet 83 of the vane pump 5 via the main-side oil path a1, and regulates a hydraulic pressure discharged from the main-side pump portion 71 of the vane pump 5 to a line pressure PL. The line pressure PL is used to control a primary pulley and a secondary pulley (not illustrated) of the speed change mechanism 2, for example.

The secondary regulator valve 62 regulates a hydraulic pressure discharged from the primary regulator valve 61 to a secondary pressure Psec. The secondary pressure Psec is used to control a torque converter (not illustrated) of the speed change mechanism 2, for example. Furthermore, a hydraulic pressure discharged from the secondary regulator valve 62 is used as lubricating oil for the speed change mechanism 2, for example, and a part of the hydraulic pressure returns from the suction oil path 66 to the main-side suction inlet 81 as the extra hydraulic pressure P1 via the lubrication check valve 65.

Meanwhile, a hydraulic pressure discharged from the sub-side pump portion 72 of the vane pump 5 is supplied from the sub-side discharge outlet 84 to the primary regulator valve 61 via the sub-side oil path a2, and fed from the primary regulator valve 61 by way of the secondary regulator valve 62 to be used as lubricating oil for the speed change mechanism 2. A part of the hydraulic pressure returns from the suction oil path 66 to the main-side suction inlet 81 as the extra hydraulic pressure P1. In the case where the hydraulic pressure in the sub-side oil path a2 is higher than the hydraulic pressure in the main-side oil path a1, the hydraulic pressure in the sub-side oil path a2 flows into the main-side oil path a1 through the first sub check valve 63 to generate the line pressure PL. Similarly, in the case where a hydraulic pressure on the sub side is higher than a hydraulic pressure on the main side at the time of discharge from the primary regulator valve 61, the hydraulic pressure on the sub side flows into the main side through the second sub check valve 64 to generate the secondary pressure Psec.

Next, operation of the vehicle drive device 1 will be described.

When the drive source (not illustrated) is started and the vane pump 5 is actuated to rotate at a low speed, the main-side pump portion 71 suctions oil from the main-side suction inlet 81 and the sub-side pump portion 72 suctions oil from the sub-side suction inlet 82 at the same time. Here, when the drive source has just been started and the rotational speed is low, the discharge amount of the vane pump 5 is small, and the extra flow rate from the hydraulic supply circuit 60 is low. Therefore, an inflow of oil from the suction oil path 66 cannot be expected, but a pressure loss caused in the main-side pump portion 71 is suppressed to suppress occurrence of cavitation by supplying a necessary and sufficient amount of oil suctioned from the sub-side suction inlet 82 to the main-side pump portion 71 via the communication oil path 79.

When the drive source is driven at a high speed and the vane pump 5 is actuated to rotate at a high speed, the amount of oil discharged from the vane pump 5 is increased to increase the extra flow rate. In the case where the extra flow rate is higher than the flow rate of oil suctioned from the strainer 4, a pressure loss is suppressed to suppress occurrence of cavitation by supplying the extra flow rate to the sub-side pump portion 72 via the communication oil path 79.

In the vehicle drive device 1 according to the embodiment, as has been described above, the main-side suction inlet 81 of the vane pump 5 communicates with the suction oil path 66, and the sub-side suction inlet 82 communicates with the strainer 4. Thus, oil paths can be disposed without being merged with each other in the case where the valve body 6 is disposed on the opposite side of the vane pump 5 from the strainer 4. Consequently, it is possible to improve the degree of freedom in design.

In the vehicle drive device 1 according to the embodiment, in addition, the main-side suction inlet 81 of the vane pump 5 communicates with the suction oil path 66, and the sub-side suction inlet 82 communicates with the strainer 4. Thus, it is possible to suction not only oil from the strainer 4 but also the extra hydraulic pressure P1 from the valve body 6. Therefore, a pressure loss during suctioning is reduced compared to a case where only oil from the strainer 4 is suctioned. Thus, it is possible to suppress occurrence of cavitation.

In the vehicle drive device 1 according to the embodiment, in addition, the vane pump 5 has the communication oil path 79 which communicates with the main-side suction inlet 81 and the sub-side suction inlet 82. Therefore, when the vane pump 5 is rotating at a low speed, a hydraulic pressure suctioned from the sub-side suction inlet 82 can flow through the communication oil path 79 to flow into the main-side suction port 73 in a circulating manner. When the vane pump 5 is rotating at a high speed, meanwhile, a hydraulic pressure at the main-side suction port 73 flows through the communication oil path 79 to flow into the sub-side suction port 75 in a circulating manner. Thus, a pressure loss caused in the sub-side pump portion 72 is compensated for to suppress occurrence of cavitation.

In the vehicle drive device 1 according to the embodiment, in addition, the valve body 6 is disposed on the opposite of the vane pump 5 from the strainer 4. Consequently, the valve body 6 can be installed on the front surface of the case 3, which can contribute to a reduction in size of the vehicle.

In the vehicle drive device 1 according to the embodiment, in addition, the valve body 6 is installed on a side surface of the case 3, and the vane pump 5 is installed inside the case 3. Therefore, the vehicle drive device 1 can be suitably applied to a vehicle such as an automobile. In the embodiment, in particular, the valve body 6 is installed on the front surface of the case 3, which can contribute to a reduction in size of the vehicle.

In the embodiment discussed above, the main-side suction inlet 81 communicates with the suction oil path 66, and the sub-side suction inlet 82 communicates with the strainer 4. However, the present disclosure is not limited thereto. For example, the main-side suction inlet 81 may communicate with the strainer 4, and the sub-side suction inlet 82 may communicate with the suction oil path 66.

In the embodiment discussed above, in addition, the hydraulic supply circuit 60 includes the primary regulator valve 61 and the secondary regulator valve 62. However, the present disclosure is not limited thereto. For example, the hydraulic supply circuit 60 may not have the secondary regulator valve 62, so that the secondary pressure Psec is not generated. In this case, a hydraulic pressure discharged from the primary regulator valve 61 can be supplied to the suction oil path 66.

The embodiment includes at least the following configuration. The embodiment provides a transfer device (1) including: a case (3) that houses a transfer mechanism (2); a strainer (4) that suctions oil stored in a lower portion (3*a*) of the case (3); a valve body (6) that has a hydraulic supply circuit (60) that supplies a hydraulic pressure to the transfer mechanism (2) and a suction oil path (66) that discharges an extra hydraulic pressure (P1) that is extra for the hydraulic supply circuit (60); a first suction inlet (81) that communicates with one of the suction oil path (66) and the strainer (4) and a second suction inlet (82) that communicates with the other of the suction oil path (66) and the strainer (4); and a balanced vane pump (5) that has a first suction port (73) which faces the first suction inlet (81) and into which oil flows from the first suction inlet (81), a second suction port (75) which faces the second suction inlet (82) and into which oil flows from the second suction inlet (82), a first discharge outlet (83) and a second discharge outlet (84) that discharge oil having flowed thereinto from the first suction inlet (81) and the second suction inlet (82) to the hydraulic supply circuit (60), and a communication oil path (79) disposed downstream of the first suction port (73) and downstream of the second suction port (75) to communicate between the first suction port (73) and the second suction port (75).

In this configuration, the first suction inlet (81) of the vane pump (5) communicates with the suction oil path (66), and the second suction inlet (82) communicates with the strainer (4). Thus, oil paths can be disposed without being merged with each other in the case where the valve body (6) is disposed on the opposite side of the vane pump (5) from the strainer (4). Consequently, it is possible to improve the degree of freedom in design. In addition, a flow rate from the suction oil path (66) and the strainer (4) is supplied to the first and second suction ports (73, 75) through the communication oil path (79). Thus, not only oil from the strainer (4) but also an extra hydraulic pressure (P1) from the valve body (6) can be suctioned. Therefore, the hydraulic pressure of oil being suctioned is increased compared to a case where only oil from the strainer (4) is suctioned. Thus, it is possible to suppress occurrence of cavitation during low-speed rotation and high-speed rotation of the vane pump (5).

In the transfer device (1) according to the embodiment, in addition, the valve body (6) is disposed on the opposite side of the vane pump (5) from the strainer (4). With this configuration, the valve body (6) can be installed on the front surface of the case (3), which can contribute to a reduction in size of the vehicle.

INDUSTRIAL APPLICABILITY

The present transfer device is suitably used for a transfer device that is suitable for application to a vehicle such as an automobile, and in particular for a transfer device to which a vane pump is applied as an oil pump that generates a hydraulic pressure of working oil or lubricating oil to be supplied to a transfer mechanism.

The invention claimed is:

1. A transfer device comprising:

a case that houses a transfer mechanism;

a strainer that suctions oil stored in a lower portion of the case;

a valve body that has a hydraulic supply circuit that supplies a hydraulic pressure to the transfer mechanism and a suction oil path that discharges extra hydraulic pressure that is extra for the hydraulic supply circuit;

a first suction inlet that communicates with one of the suction oil path and the strainer and a second suction inlet that communicates with the other of the suction oil path and the strainer; and a balanced vane pump that has:

a drive shaft, a rotor fixed to the drive shaft, a vane capable of protruding and retracting in a radial direction with respect to the rotor, and a cam ring, an inner peripheral surface of the cam ring being in sliding contact with a distal end of the vane, a first suction port which faces the first suction inlet, opens to an inner circumferential side of the cam ring and into which oil flows from the first suction inlet, a second suction port which faces the second suction inlet, opens to the inner circumferential side of the cam ring and into which oil flows from the second suction inlet, a first discharge outlet and a second discharge outlet that discharge oil having flowed thereinto from the first suction inlet and the second suction inlet to the hydraulic supply circuit, and a communication oil path disposed on the inner circumferential side of the cam ring as viewed from an axial direction of the drive shaft to communicate between the first suction port and the second suction port, wherein the communication oil path has a first communicating oil path that extends between the first suction port and the second suction port on a first side of the drive shaft and a second communicating oil path that extends between the first suction port and the second suction port on a second side of the drive shaft opposite the first side of the drive shaft, as viewed from the axial direction of the drive shaft.

2. The transfer device according to claim 1, wherein the valve body is disposed on an opposite side of the vane pump from the strainer.

3. The transfer device according to claim 1, wherein the communication oil path communicates between an inner circumferential side, centered on the drive shaft, of the first suction port and an inner circumferential side, centered on the drive shaft, of the second suction port.

* * * * *